US005393449A

United States Patent [19]

Jordan et al.

[11] Patent Number: 5,393,449

[45] Date of Patent: Feb. 28, 1995

[54] PERSONAL CLEANSING STAMPED SYNBAR CONTAINING ALKYL GLYCERYL ETHER SULFONATE AND ACYL ISETHIONATE

[75] Inventors: Neil W. Jordan; Wayne E. Eccard, both of Cincinnati; James R. Schwartz, West Chester, all of Ohio

[73] Assignee: The Procter & Gamble Company, Cincinnati, Ohio

[21] Appl. No.: 835,055

[22] Filed: Feb. 11, 1992

Related U.S. Application Data

[63] Continuation of Ser. No. 488,926, Mar. 5, 1990, abandoned.

[51] Int. Cl.[6] ..... C11D 1/28; C11D 1/04; C11D 13/18; C11D 17/00

[52] U.S. Cl. ..... 252/121; 252/134; 252/554; 252/557; 252/DIG. 16; 252/174

[58] Field of Search ..... 252/174, 134, 554, 557, 252/DIG. 16, 121

[56] References Cited

U.S. PATENT DOCUMENTS

| | | | |
|---|---|---|---|
| 2,894,912 | 7/1959 | Geitz | 252/121 |
| 2,987,484 | 6/1961 | Lundberg | 252/174 |
| 3,376,229 | 4/1968 | Haass | 252/117 |
| 3,761,418 | 9/1973 | Parron | 252/106 |
| 4,007,125 | 2/1977 | Prince | 252/117 |
| 4,110,239 | 8/1978 | Prince | 252/135 |
| 4,180,470 | 12/1979 | Tokosh | 252/121 |
| 4,696,767 | 9/1987 | Novakovic et al. | 252/557 |
| 4,812,253 | 3/1989 | Small | 252/132 |
| 4,820,447 | 4/1989 | Medcalf | 252/117 |
| 4,832,861 | 5/1989 | Resch | 252/106 |
| 4,923,627 | 5/1990 | Joshi | 252/108 |
| 4,954,281 | 9/1990 | Resch | 252/107 |

FOREIGN PATENT DOCUMENTS 796627 6/1958 European Pat. Off. .

*Primary Examiner*—Paul Lieberman
*Assistant Examiner*—Erin M. Higgins
*Attorney, Agent, or Firm*—Leonard Williamson

[57] ABSTRACT

This invention comprises a personal cleansing stamped synbar with improved processing based on an ultra mild, good foaming, alkyl glyceryl ether sulfonate and a co-surfactant acyl isethionate processing aid.

10 Claims, No Drawings

PERSONAL CLEANSING STAMPED SYNBAR CONTAINING ALKYL GLYCERYL ETHER SULFONATE AND ACYL ISETHIONATE

This is a continuation of application Ser. No. 07/488,296, filed on Mar. 5, 1990, now abandoned.

TECHNICAL FIELD

This invention relates to mild synthetic detergent, personal cleansing bars (synbars) and to processes of making them.

BACKGROUND OF THE INVENTION

Personal cleansing with mild surface-active cleansing preparations has become a focus of interest. Some of the problems associated with mild bars comprised of synthetic detergents (synbars) are bar processability, firmness, lather and rinsing. The problems of formulating synbars are not limited to the performance characteristics of the finished bar. Most synbars which are made with certain mild surfactants are very difficult to fabricate. In contrast, the fabrication of "soap" bars is a well-worked-out engineering procedure involving milling, plodding and molding. Soap becomes quite plastic when warmed and can be easily plodded and molded under relatively low pressures. Most synthetic detergents and detergent-filler combinations do not become plastic and the machinery for fabrication must be specially designed. See U.S. Pat. No. 2,678,921, J. A. V. Turck, Jr., issued May 18, 1954. Ideal synbar processing should be fast and problem free in terms of milling, plodding and molding toilet bar formation. Most synbar processing falls short in this respect.

The development of soap-synthetic bars (synbars) dates back to World War II. U.S. Pat. No. 2,432,169, Hoyt, describes a bar having soap and alkyl benzene sulfonate as the active and a substantial proportion of corn starch as a binder; and U.S. Pat. No. 2,988,511, Mills and Korpi, issued Jun 13, 1961, describes a nonsmearing bar comprising alkyl glyceryl ether sulfonate, soap and binder. U.S. Pat. No. 2,982,735, Blinka and Grounds, Jr, issued May 2, 1961, discloses a detergent milled bar comprising soap, anionic detergent and starch. U.S. Pat. No. 2,987,484, Lundberg and Blinka, issued Jun 6, 1961, discloses a closed die injection molded detergent bar comprising alkyl glyceryl ether sulfonate and acyl isethionate. Some other uses and procedures for making alkyl glyceryl ether sulfonate are disclosed in U.S. Pat. Nos.: 2,094,489, Hulter, issued Sep. 28, 1937; 2,427,576, Smith, issued Sep. 16, 1947; 2,427,577, Smith, issued Sep. 16, 1947; 2,989,547, Whyte, issued Jun 20, 1961; 2,999,068, Pilcher et al., issued Sep. 5, 1961; and 3,024,273, Whyte et al., issued Mar. 6, 1962, all of said patents incorporated herein by reference.

It is noted that surfactant mildness can be measured by a skin barrier destruction test which is used to assess the irritancy potential of surfactants. In this test the milder the surfactant, the less the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; in U.S. Pat. No. 4,673,525, Small et al., issued Jun 16, 1987, and in copending U.S. patent application Ser. No. 294,832, Small et al., filed Jan. 9, 1989.

U.S. Pat. No. 2,894,912, Geitz, issued Jul 14, 1959, for "Isethionate Detergent Bar," discloses a detergent bar consisting essentially of from 30–70% of water-soluble alkali metal detergent salts of esters of isethionic acid with mixed aliphatic fatty acids having from 6 to 18 carbon atoms and an iodine value of less than 20, of which mixed acids at least 75% have from 12 to 18 carbon atoms and up to 25% have from 6 to 10 carbon atoms, from 2–10% of at least one water-soluble suds-boosting detergent salt selected from the group consisting of alkali metal and organic amine higher aliphatic fatty alcohol sulfates, alkyl aryl sulfonates, and higher aliphatic fatty acid taurides, from about 1% to about 9% water, from about 2.5% to about 25% of water-soluble higher fatty acid soap, and from 10–40% of at least one higher fatty acid having from about 12 to about 25 carbon atoms as a binder and plasticizer, said bar having a pH within the range from 6 to 8, measured as a 10% aqueous solution of the bar composition at 35° C.

U.S. Pat. No. 4,180,470, Tokosh et al., issued Dec. 25, 1979, discloses a method for making improved 30–70% acyl isethionate detergent bars with from 2–6% of sodium alkoxy hydroxy propane sulfonate (a synonym for alkyl glyceryl ether sulfonate) with alkyl chains of from 8 to 22 carbon atoms in conjunction with a small amount of sodium chloride. $C_{18}$ alkyl glyceryl ether sulfonate at 5% is used in an example. The added alkyl glyceryl ether sulfonate and salt are used to improve bar wear rate without adversely affecting its lathering characteristics.

U.S. Pat. No. 4,234,464, Morshauser, issued Nov. 18, 1980, for "Detergent Bar Composition and Binder Therefor," discloses a detergent bar in Example 6 which comprises: 45% sodium cocoyl isethionate, 5% alkyl amide, 37.5% stearic acid, 5.0% hydrogenated tallow glycerides, and 1% Polymer JR. Morshauser teaches that his detergent bars can contain up to 5% soap "without substantial detriment."

U.S. Pat. No. 4,012,341, Orshitzer et al., issued Mar. 15, 1977, for a "Unique All Synthetic Detergent Shampoo Bar," discloses a bar comprising a mixture of anionic and nonionic detergents. The Examples are primarily based on sodium lauryl sulfate, which is an unacceptable primary surfactant for the present invention.

U.S. Pat. No. 3,761,418, Parran, Jr., issued Sep. 25, 1973, for "Detergent Compositions Containing Particle Deposition Enhancing Agents," discloses detergent compositions including a bar, which main surfactant is alkyl sulfate, which is unacceptable for the mild skin cleanser of the present invention.

Major drawbacks of most synthetic surfactant toilet bar formulations are poor processability due to stickiness, harshness, poor lather, or poor rinse feel. The use of high sudsing anionic surfactants can yield acceptable lather volume. Unfortunately, the highest sudsing anionic surfactants are, in fact, poor in processabilty. While the prior art mild blends of sodium coconut/tallow alkyl glyceryl ether sulfonate are relatively good in lather potential, they are not so easy to process because of their stickiness or hygroscopicity. It will be appreciated that processability, mildness, lather, and rinsability make surfactant selection for mild synbars a delicate balancing act. Thus, it will be appreciated that rather stringent requirements for formulating mild synbars limit the choice of surfactants, and final formulations represent some degree of compromise. Mildness is often obtained at the expense of processability, effective cleansing, lathering, or rinsing, or vice versa. Needless to say, a superior processable synbar formulation with good mildness, good lather potential and good tinsability is hard to formulate.

OBJECTS OF THE INVENTION

An object of the present invention is to provide a stamped synbar which has improved processability.

Another object of the present invention is to provide a processing aid for making stamped synbars of which the major surfactant is alkyl glyceryl ether sulfonate.

Yet another object is to use an acyl isethionate co-surfactant as a processing aid in a stamped synbar of which alkyl glyceryl ether sulfonate is the major surfactant.

Other objects will become apparent from the detailed description below.

SUMMARY OF THE INVENTION

This invention is an improved personal cleansing stamped synbar based on alkyl glyceryl ether sulfonate, alkyl glyceryl ether sulfonate being the primary synthetic detergent surfactant, and an acyl isethionate co-surfactant as a processing aid.

DETAILED DESCRIPTION OF THE INVENTION

The invention relates a synbar made from a mix of from about 30% to about 80% of mild alkyl glyceryl ether sulfonate detergent surfactant mixture and from about 5% to about 30% acyl isethionate co-surfactant processing aid. The preferred weight ratio of the alkyl glyceryl sulfonate mixture and the processing aid is from about 10:1 to about 1.2:1, preferably about 8:1 to about 1.5:1, more preferably 6:1 to 1.5:1.

The term "alkyl glyceryl ether sulfonate" as used herein means a mixture of alkyl glyceryl ether sulfonate (AGS) surfactants having alkyl chains of from 8–22 carbon atoms, preferably from 10–20 carbon atoms, and more preferably from 12–18 carbon atoms. The preferred AGS mixtures are derived from blends of coconut and tallow alcohols. The synbars of this invention also are preferably about as mild as a comparable bar made with standard AGS. The standard AGS is defined herein as an alkyl glyceryl ether sulfonate which has an alkyl carbon chain percentage and distribution of about 58/21/10/9%—$C_{12}/C_{14}/C_{16}/C_{18}$.

A preferred AGS mixture contains from about 20% to about 50%, preferably from about 25% to about 40%, of alkyl chains of 16 and 18 carbon atoms wherein the ratio of the $C_{16}$ to $C_{18}$ chains is from about 1:2 to about 1:4, preferably from about 1:1 to about 1:3. Alkyl glyceryl ether sulfonates are derived from corresponding ethers consisting of straight alkyl chains which are in turn derived from their corresponding synthetic or natural alcohols. Also included as $C_{16}$–$C_{18}$ alkyl glyceryl ether sulfonate are the alkyl glyceryl ether sulfonate equivalents derived from ethers having branched chains that emulate said $C_{16}$–$C_{18}$ straight chain lengths, e.g., those derived from branched alcohols of about the same number of carbon atoms. Procedures for making alkyl glyceryl ether sulfonate are disclosed in U.S. Pat. Nos.: 2,094,489, Hulter, issued Sep. 28, 1937; 2,427,576, Smith, issued Sep. 16, 1947; 2,427,577, Smith, issued Sept. 16, 1947; 2,989,547, Whyte, issued Jun 20, 1961; 2,999,068, Pilcher et al., issued Sep. 5, 1961; and 3,024,273, Whyte et al., issued Mar. 6, 1962, all of said patents incorporated herein by reference.

Commonly assigned U.S. Pat. No. 4,673,525, supra, discloses a mild alkyl glyceryl ether sulfonate surfactant based synbar comprising alkyl glyceryl ether sulfonate. The synbars of this invention exhibit improved processability over the synbars disclosed in Small et al. The improved processing over a comparable synbar made with a standard alkyl glyceryl ether sulfonate is an unexpected processing advantage.

The preferred synbar formulations of this invention have a Relative Crutcher Mix Viscosity Value (as defined hereinbelow) of less than 1, preferably less than 0.9, more preferably less than 0.8. The synbar of this invention has a Relative RCAT (Rolling Cylinder Adhesion Test) Value of less than 1, preferably less than 0.9, and more preferably less than 0.8. A Relative RCAT Value of 1 is assigned to a comparable bar made without the processing aid. A comparable bar has a total synthetic surfactant system level of about that of the synbar of this invention wherein the processing aid co-surfactant makes the difference between the two formulas.

The Processing Aid

The co-surfactant processing aid is acyl isethionate. Acyl isethionates are aliphatic higher fatty acid esters of an alkali metal isethionic acid salt and can be defined by the following general formula: $RCOOCH_2CH_2SO_3M$ wherein R is an aliphatic radical or mixed aliphatic radical of a higher fatty acid or mixture thereof, having from about 6 to about 20 carbon atoms, preferably from about8 to about 18 carbon atoms, e.g., cocoyl or an approximately equivalent distribution of chain lengths, the longer chains (16 and 18) being more preferred; and wherein M is an alkali metal cation such as sodium, potassium, or ammonium, or an organic amine base such as triethanolamine, triisopropanolamine, diethanolamine and ethanolamine. The preferred cations in the AGS and the acyl isethionate salts are sodiums.

The alkyl glyceryl ether sulfonate and the acyl isethionate co-surfactant processing aid are essential to the synbars of this invention. The synbar comprises: about 30–80%, preferably about 35–70% of alkyl glyceryl ether sulfonate detergent surfactant; and from about 5% to about 30%, preferably from about 10% to about 25%, of acyl isethionate processing aid. Other synbar ingredients selected from: other surfactants, polymeric skin feel aids, moisturizers, fillers, soaps, etc., can be used. The synbars also have about 10–40%, preferably about 15–35%, moisturizer; about 0–8%, preferably about 0.2–2%, polymeric skin feel aid if present; and about 1–25%, preferably about 7–20%, soap. The synthetic surfactant and soap, when present, preferably have a ratio of from 2:1 to 14:1, more preferably the synthetic to soap ratio is from 4:1 to 12:1, or from 6:1 to 10:1.

Limited amounts of other surfactants can be used with the alkyl glyceryl ether sulfonate surfactant and processing aid co-surfactant mixture of this invention, preferably less than 30% of the surfactant system, more preferably less than 20%. Numerous examples of other surfactants are disclosed in the patents incorporated herein by reference. They include alkyl sulfates, soaps, anionic acyl sarcosinates, methyl acyl taurates, N-acyl glutamates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates. Alkyl chains for these surfactants are $C_8$–$C_{22}$, preferably $C_{10}$–$C_{18}$. Alkyl glycosides and methyl glucose esters are preferred mild nonionics which may be mixed with at least one of said mild anionic or amphoteric surfactants in the compositions of this invention.

Soaps at levels of 1–25%, preferably 5.5–15%, can be included in bar compositions of this invention. The soaps are added as is or made in situ via adding a base, e.g., NaOH, to convert free fatty acids in the composition mix. Other ingredients of the present invention are selected for the various applications. E.g., perfumes can be used in formulating the skin cleansing products, generally at a level of from about 0.1% to about 1.5% of the composition. Alcohols, hydrotropes, colorants, and fillers such as talc and clay, can also be used. Preservatives, e.g., sodium ethylenediaminetetraacetate (EDTA), generally at a level of less than 1% of the composition, can be incorporated in the cleansing products to prevent microbiological growth. Antibacterials can also be incorporated, usually at levels up to 1.5%.

A Process for Making the Personal Cleansing Synbar

In order to make the product, an analysis of the surfactant paste is needed. To illustrate the process, an AGS paste with the following nominal analysis will be used.

Cationic Titration for $SO_3$=48.5% AGS
NaCl=1.5%
Moisture=43%

After the composition of the AGS paste is determined, all other ingredients are added such that the crutcher mix is calculated to contain about 55% moisture and about 4% NaCl in the final bar.

Crutching

Assuming the crutcher mix has been calculated from the AGS analysis described above:

1. Add hot water (130°–140° F., 54°–60° C.) to the crutcher.
2. Add the predetermined quantity of AGS paste to the water in the crutcher. The AGS paste can be at ambient temperature or preheated to 150° F. (65° C.).
3. Turn on the agitator and recirculation pump and maintain temperature in crutcher at 130°–150° F. (54°–65° C.) by adjusting steam and water valves.
4. Add predetermined quantity of Hamposyl L-30 solution to the crucher mix.
5. Allow contents in crutcher mix to return to 130°–150° F. (54°–65° C.) prior to adding predetermined quantity of stearic acid.
6. Add to heated crutcher mix predetermined quantity of soap or NaOH to form in-situ soap.
7. Allow the contents in the crutcher to mix and/or react for about 15 minutes while maintaining the temperature at 130°–150° F. (54°–65° C.).
8. Add to heated crutcher mix the predetermined quantity of acyl isethionate. Allow contents in crutcher to mix for about 20 minutes while maintaining temperature at 130°–150° F. (54°–65° C.).
9. Add sodium chloride and titanium dioxide to the heated crutcher mix.
10. Add lauric and/or coconut fatty acids to crutcher mix and allow contents of crutcher to mix for about 15 minutes while maintaining temperature at 130°–150° F. (54°–65° C.).

Drying

The crutcher mix is dried and cooled using a combination flash chamber and chill roll or chill belt. The crutcher mix i s first heated to approximately 300° F. (149° C.) by a heat exchanger and then flash dried in a chamber above the chill roll or chill belt. From the flash chamber the hot, dried mix is extruded onto the chill roll or chill belt. The chill belt or chill roll provides a uniform, thin, cool (85°–95° F., 29°–35° C.) product in flake or chip form. Typical moisture for the flake is 2–10%, preferably 2–4.5%. The ways to regulate the moisture, in the order of preference, are (1) increasing or decreasing steam pressure on the heat exchanger; (2) increasing or decreasing crutcher mix rate to the heat exchanger; and (3) increasing or decreasing crutcher mix temperature to the heat exchanger.

Amalgamating

The flakes are weighed and mixed in a batch amalgamator to obtain uniform flake size. Preweighed perfume is added to the flakes and mixed in the amalgamator to obtain the desired finished product perfume level. The perfumed flakes are transferred to the mix hopper or directly to the plodder.

Milling (Optional)

The 3-roll soap mills are set up with the first roll at 100° F. (38° C.) and the other two mills at about 70° F. (21° C.). The soap is passed through the mills several times to provide a homogeneous mixture of perfume and dried flakes.

Plodding and Stamping

The plodder is set up with the barrel temperature at about 95° F. (35° C.) and the nose temperature at 100°–120° F. (38°–49° C.). The ideal plodder is a dual stage plodder that allows use of a vacuum of about 15–25 inches of Hg. The plugs should be cut in 5" sections and stamped with a cold die block using die liquor such as alcohol, if appropriate.

The following patents disclose or refer to such ingredients and formulations which can be used in the synbars of this invention, and are incorporated herein by reference:

| Pat. No. | Issue Date | Inventor(s) |
|---|---|---|
| 4,234,464 | 11/1980 | Morshauser |
| 4,061,602 | 12/1977 | Oberstar et al. |
| 4,472,297 | 9/1984 | Bolich et al. |
| 4,491,539 | 1/1985 | Hoskins et al. |
| 4,540,507 | 9/1985 | Grollier |
| 4,673,525 | 6/1987 | Small et al. |
| 4,704,224 | 11/1987 | Saud |
| 4,812,253 | 3/1989 | Small et al. |
| 4,820,447 | 4/1989 | Medcalf et al. |

EXAMPLES

The following examples and methods are illustrative and are not intended to limit the scope of the invention(s). The detailed methods of making and purifying generic alkyl glyceryl ether sulfonate per se are disclosed in U.S. Pat. No. 2,988,511, supra, incorporated herein by reference. The percentages, ratios, and parts herein are on a total composition or surfactant weight basis, as indicated, unless otherwise specified. All levels and ranges herein are approximations unless otherwise specified. All levels and ranges, temperatures, results etc., used herein are approximations unless otherwise specified. The synbars of Examples 1–10 are made using the above process.

TABLE 1

| | Ingredient | | | | | | | |
|---|---|---|---|---|---|---|---|---|
| | Ex. 1 | Ex. 2 | Ex. 3 | Ex. 4 | Ex. 5 | Ex. 6 | Ex. 7 | Ex. 8 |
| Sodium AGS* | 50.73 | 50.73 | 43.73 | 35.73 | 45.23 | 41.98 | 41.78 | 41.78 |
| Sodium Cocoyl Isethionate | 13.0 | 5.0 | 20.0 | 20.0 | 14.5 | 20.0 | 20.0 | 20.0 |
| Sodium Lauroyl Sarcosinate | 4.0 | 12.0 | 4.0 | 12.0 | 8.0 | 6.0 | 6.0 | 6.0 |
| Coconut-Fatty Acid | 6.53 | 6.53 | 6.53 | 6.53 | 6.53 | 6.53 | — | — |
| Lauric Acid | | | | | — | — | 6.53 | — |
| Stearic Acid | 9.78 | 9.78 | 9.78 | 9.78 | 9.78 | 9.78 | 9.78 | 16.31 |
| In Situ Soap (60 Stearate/40 Laurate) | | | | | — | — | 7.21 | — |
| In Situ Soap (Stearate) | | | | | — | — | — | 7.21 |
| Sodium Soap (70 Tallow/30 Coconut) | 7.21 | 7.21 | 7.21 | 7.21 | 7.21 | 7.21 | — | — |
| Sodium Chloride | 4.0 | 4.0 | 4.0 | 4.0 | 4.0 | 4.0 | 4.2 | 4.2 |
| Titanium Dioxide | 0.25 | 0.25 | 0.25 | 0.25 | 0.25 | 0.25 | 0.25 | 0.25 |
| Fragrance | 1.0 | 1.0 | 1.0 | 1.0 | 1.0 | 1.0 | 1.0 | 1.0 |
| Water | 3.50 | 3.50 | 3.50 | 3.50 | 3.50 | 3.25 | 3.25 | 3.25 |

*Standard AGS

TABLE 2

| Finished Bar Compositions (Wt. %) | | |
|---|---|---|
| Ingredient | Comparative Example 9 | Example 10 |
| Standard AGS | 55.25 | — |
| Heavy Cut AGS* | — | 40.0 |
| Sodium Lauroyl Sarcosinate | 12.5 | 8.0 |
| Sodium Cocoyl Isethionate | — | 20.0 |
| Stearic Acid | 9.8 | 9.8 |
| Lauric Acid | 6.5 | 6.5 |
| In Situ Soap (60 Stearate/40 Laurate) | 7.2 | — |
| Sodium Soap (70 Tallow/30 Coconut) | — | 7.2 |
| Sodium Chloride | 4.0 | 4.0 |
| Titanium Dioxide | 0.25 | 0.25 |
| Fragrance | 1.0 | 1.0 |
| Water | 3.5 | 3.25 |

*$C_{12}/C_{14}/C_{16}/C_{18}$ - 52/19/11/18%

Relative Crutcher Mix Viscosity Test

The viscosity of the synbar crutcher mix is taken at about 130° F. (54° C.) using a Brookfield LVT, 6 rpm, Spindle #4. The crutcher mix viscosity of a comparable bar formulation without the processing aid has a Relative Crutcher Mix Viscosity of 1 and the crutcher mix viscosity of the present invention has a Relative Crutcher Mix Viscosity of less than 1, preferably less than 0.9, more preferably less than 0.8.

TABLE 3

| Relative Crutcher Mix Viscosities | | |
|---|---|---|
| Example | Viscosity (cps) | RCMV |
| 1 | 43,166 | 0.94 |
| 2 | 51,167 | 1.11* |
| 3 | 26,000 | 0.57 |
| 4 | 10,850 | 0.24 |
| 5 | 13,150 | 0.29 |
| 6 | 21,000 | 0.46 |
| 7 | 17,230 | 0.37 |
| 8 | 18,600 | 0.40 |
| 9** | 46,000 | 1.0 |

*Although Example 2 has a Relative Crutcher Mix Viscosity of greater than 1, it has a RCAT Value of less than 1. See Table 4.
**Comparative Synbar.

Rolling Cylinder Adhesion Test (RCAT) Methodology

The rolling cylinder adhesion test, (RCAT) is designed to simulate the adhesion of the processed synbar formulation to the surfaces of the the processing of equipment (drying/flaking/plodding/milling/stamping). It has been shown to correlate with stickiness of products during processing. This stickiness is inversely related to overall bar processability. The synbar of this invention has a Relative RCAT (Rolling Cylinder Adhesion Test) Value of less than 1, preferably less than 0.9, and more preferably less than 0.8. A Relative RCAT Value of I is assigned to a comparable bar made without the processing aid.

The equipment used for this test is the following. An inclined plane (15°) with raised edges is used as the base for the rolling cylinder. The cylinder itself is made from plexiglass tubing of 4" outer diameter and $11\frac{7}{8}$" overall length; it weighs 735.2 grams.

All evaluations are conducted in a constant temperature/humidity environment at 80° F. (26° C.) and 15% relative humidity. The synbar product to be tested is grated into small pieces (about 2 mm in length). About 20 grams of the grated product are spread evenly over the surface of the inclined plane. The preweighed cylinder is then placed at the head of the inclined plane and allowed to roll freely over the material until it reaches the end of the run. The cylinder is reweighed, the difference being the weight of material adhering to it. The higher the amount of material adhering to the cylinder, the stickier the product and the more difficult to process. The data is expressed as a percentage of material stuck to the cylinder (RCAT %) relative to the amount of material available (20 grams).

TABLE 4

| Rolling Cylinder Adhesion Test (RCAT) Values | | |
|---|---|---|
| Example | RCAT (%) | Rel. RCAT* |
| 1 | 48.8 | 0.86 |
| 2 | 46.3 | 0.82 |
| 3 | 41.9 | 0.74 |
| 4 | 16.3 | 0.29 |
| 5 | 37.2 | 0.66 |
| 6 | 32.8 | 0.58 |
| 7 | 21.8 | 0.39 |
| 8 | 17.3 | 0.31 |
| 9** | 56.5 | 1.0 |

*RCAT/56.5
**Comparative Synbar

It is noted that the stamped personal cleansing synbars of this invention, Examples 1–8, all have RCMV and Relative RCAT Values of less than those of the comparable synbar Example 9, save the RCMV Value of Example 2 which has a Relative RCAT Value of 0.82. Any lower RCAT or RCMV Value translates into a surprisingly and unexpectedly improved processability advantage for the stamped personal cleansing synbars of this invention vs. the comparable synbar.

What is claimed is:

1. A process for making a flaked, plodded and stamped personal cleansing synbars comprising the following steps:

(A) mixing in a crutcher on a dried final bar weight basis from about 30% to about 80% of $C_8$–$C_{22}$ alkyl glyceryl ether sulfonate (AGS) surfactant; from about 5% to about 30% of $C_6$–$C_{20}$ acyl isethionate processing aid; said alkyl glyceryl ether sulfonate and processing aid having a weight ratio of from about 1.2:1 to about 10:1; from about 5% to about 25% soap; and said crutcher mix containing from about 45% to about 65% water;

(B) flash drying said crutcher mix with heat to a moisture content of from about 2% to about 10%; and then cooling; and (C) flaking said flash dried mix to provide homogeneous dried flakes; and (D) plodding and forming plugs from said cooled dried flakes and stamping said synbars from said plugs.

2. The process of claim 1 wherein said mix contains from about 35% to about 75% of said alkyl glyceryl ether sulfonate and from about 10% to about 25% of said acyl isethionate processing aid; and wherein said water of Step (A) is from about 50% to about 60%; and said moisture of Step (B) is from about 3% to about 4.5%.

3. The process of claim 1 wherein said mix contains from about 40% to about 70% of said alkyl glyceryl ether sulfonate.

4. The process of claim 1 wherein said mix contains said alkyl glyceryl ether sulfonate and said isethionate processing aid at a ratio of from about 1.5:1 to about 8:1.

5. The process of claim 4 wherein said ratio is from about 1.5:1 to about 6:1.

6. The process of claim 1 wherein said mix contains at least one other cleansing product component selected from: soaps, moisturizers, colorants, solvents, fillers, other synthetic detergent surfactants, polymeric skin feel and mildness aids, perfumes, and preservatives.

7. The process of claim 1 wherein said synbar contains a total of from about 25% to about 75% of said alkyl glyceryl ether sulfonate surfactant; of which from about 23% to about 32% is $C_{16}$–$C_{18}$ alkyl glyceryl ether sulfonate by weight of said synbar; and, wherein said synbar contains from about 0% to about 45% moisturizer; from about 0% to about 50% fillers; and from 0% to about 8% polymeric skin feel aid, by weight of the synbar.

8. The process of claim 7 wherein said mix contains from about 30% to about 70% said alkyl glyceryl ether sulfonate surfactant; from about 10% to about 40% moisturizer; and from about 10% to about 20soap.

9. The process of claim 8 wherein said synbar contains another synthetic detergent at a level of from about 5% to about 35% of total synthetic detergent surfactant.

10. The process of claim 9 wherein said level is from about 10% to about 30%.

* * * * *